US012660892B2

(12) United States Patent
Steinke, II

(10) Patent No.: US 12,660,892 B2
(45) Date of Patent: Jun. 23, 2026

(54) SNAP AND LOCK

(71) Applicant: Richard P. Steinke, II, Indio, CA (US)

(72) Inventor: Richard P. Steinke, II, Indio, CA (US)

( * ) Notice: Subject to any disclaimer, the term of this patent is extended or adjusted under 35 U.S.C. 154(b) by 83 days.

(21) Appl. No.: 18/906,156

(22) Filed: Oct. 3, 2024

(65) Prior Publication Data

US 2025/0024918 A1 Jan. 23, 2025

Related U.S. Application Data

(63) Continuation of application No. 18/456,706, filed on Aug. 28, 2023, now Pat. No. 12,133,576, which is a continuation of application No. 16/019,393, filed on Jun. 26, 2018, now Pat. No. 11,832,690, which is a continuation-in-part of application No. 15/873,168, filed on Jan. 17, 2018, now Pat. No. 11,432,620.

(60) Provisional application No. 62/447,344, filed on Jan. 17, 2017.

(51) Int. Cl.

| | |
|---|---|
| ***A44B 1/32*** | (2006.01) |
| ***A44B 1/08*** | (2006.01) |
| ***A44B 1/34*** | (2006.01) |
| *A44B 17/00* | (2006.01) |

(52) U.S. Cl.

CPC ..... *A44B 1/32* (2013.01); *A44B 1/08* (2013.01); *A44B 1/34* (2013.01); *A44B 17/0076* (2013.01); *A44D 2200/10* (2013.01); *A44D 2201/50* (2013.01)

(58) Field of Classification Search

CPC .... A44B 1/32; A44B 1/08; A44B 1/34; A44B 17/0076; A44D 2200/10; A44D 2201/50

See application file for complete search history.

(56) References Cited

U.S. PATENT DOCUMENTS

| | | | | | |
|---|---|---|---|---|---|
| 2,723,433 | A | * | 11/1955 | Buren, Jr. | A44B 17/0005 411/969 |
| 3,045,309 | A | * | 7/1962 | Johnson, Sr. | A44B 17/0082 24/94 |
| 3,718,950 | A | * | 3/1973 | Engstrom | F16B 21/078 24/663 |
| 3,863,798 | A | * | 2/1975 | Kurihara | B65D 55/12 215/301 |
| 3,979,802 | A | * | 9/1976 | Bongartz | A44B 17/0082 24/107 |
| 4,137,607 | A | * | 2/1979 | Kramer | A44B 1/04 24/95 |
| 4,580,320 | A | * | 4/1986 | Takata | A44B 1/06 24/113 MP |
| 4,959,890 | A | * | 10/1990 | Pazurek | A44B 1/14 63/29.1 |

(Continued)

*Primary Examiner* — David M Upchurch

(74) *Attorney, Agent, or Firm* — CP LAW GROUP PC; Cy Bates

(57) ABSTRACT

A button system containing two pieces that snap and lock together to fasten multiple articles of clothing. The top piece is made of three distinct parts: a detachable ridged color-coded cover, a fastener that attaches said cover to a rotatable hinged plate, and a fastener that secures all three pieces of the top piece. The bottom piece is also made up of three distinct parts: a plate to receive the hinges from the top piece, a curved structure that connects the hinge/cavity plates to the article of clothing, and a rivet that attaches to the article of clothing and the snap and lock invention.

15 Claims, 15 Drawing Sheets

(56) References Cited

U.S. PATENT DOCUMENTS

| | | | | |
|---|---|---|---|---|
| 6,009,601 | A * | 1/2000 | Kaufman | H01F 7/0263 24/49.1 |
| 6,564,434 | B1 * | 5/2003 | Morita | A45C 13/1069 24/114.2 |
| 6,895,642 | B2 * | 5/2005 | Huang | F16M 13/022 248/205.5 |
| 7,856,697 | B2 * | 12/2010 | Quimod | A44B 1/14 24/114.9 |
| 9,307,806 | B1 * | 4/2016 | Dorman | A47G 25/92 |
| 10,315,549 | B2 * | 6/2019 | Fiedler | F16B 27/00 |
| 2002/0039493 | A1 * | 4/2002 | Tanaka | G03B 17/00 396/543 |
| 2005/0223527 | A1 * | 10/2005 | Raccosta | A44B 17/0088 24/90.1 |
| 2008/0060110 | A1 * | 3/2008 | Schmelzer | A44B 1/32 2/69 |
| 2011/0225781 | A1 * | 9/2011 | Cameron | A44B 1/04 29/525 |
| 2012/0079645 | A1 * | 4/2012 | Carlson | A44B 17/0047 2/265 |
| 2014/0317822 | A1 * | 10/2014 | Friedman | A44B 17/0082 2/69 |
| 2015/0053060 | A1 * | 2/2015 | Coakley | F16C 19/54 83/745 |
| 2016/0000189 | A1 * | 1/2016 | Bolen | A44B 1/30 24/303 |
| 2016/0270487 | A1 * | 9/2016 | Chen | A44B 17/0076 |
| 2017/0210611 | A1 * | 7/2017 | Bingham | F16B 1/00 |
| 2017/0288338 | A1 * | 10/2017 | Komoto | H01R 13/26 |

* cited by examiner

SNAP AND LOCK

BACKGROUND

Field of the Invention

This invention relates to the field of buttons, specifically fasteners for articles of clothing.

Description of the Related Art

Traditional buttons have long been used to easily fasten multiple articles of clothing together. A negative trait of the ease of traditional buttons is the ease at which they become undone. The present invention sets forth a novel system to allow the user to rotate the fastening device into a locked position to secure multiple articles of clothing and prevent unwanted detachment of said articles of clothing. This invention is particularly useful in athletics, action sports, and extreme conditions.

SUMMARY

The snap and lock invention is similar to a traditional button designed for an article of clothing, generally two pieces that snap together to fasten multiple articles of clothing.

This invention comprises the traditional two pieces, however, each piece incorporates novel concepts. The top piece is made up of two parts: (1) a ridged cover that is used as both a pressure point to secure the invention, and a grip to rotate the invention in and out of the locked position, and a male fastener that attaches the rigged cover to the (2) plate with hinges that functions as the bottom of the top piece of the snap and lock. The hinged place contains a female fastener that secures the two pieces of the top portion. The bottom piece of the snap and lock invention is made up of three parts: (1) a plate to receive the hinges from the top piece, said plate either closed or open, with a cavity to allow the hinges to rotate approximately 37 degrees into a locked position, and with bumper guards to prevent the hinges from over rotation, (2) a curved structure that serves to connect the hinge/cavity plates and the article of clothing attachment, and (3) a rivet that attaches to the article of clothing and the snap and lock invention. The invention also includes a member device that holds the invention together and guides the installation or assembly.

BRIEF DESCRIPTION OF THE DRAWINGS

The foregoing and other features of the invention will become apparent from the following drawings and detailed description of the preferred embodiment of the invention.

DETAILED DESCRIPTION

Figure 1:
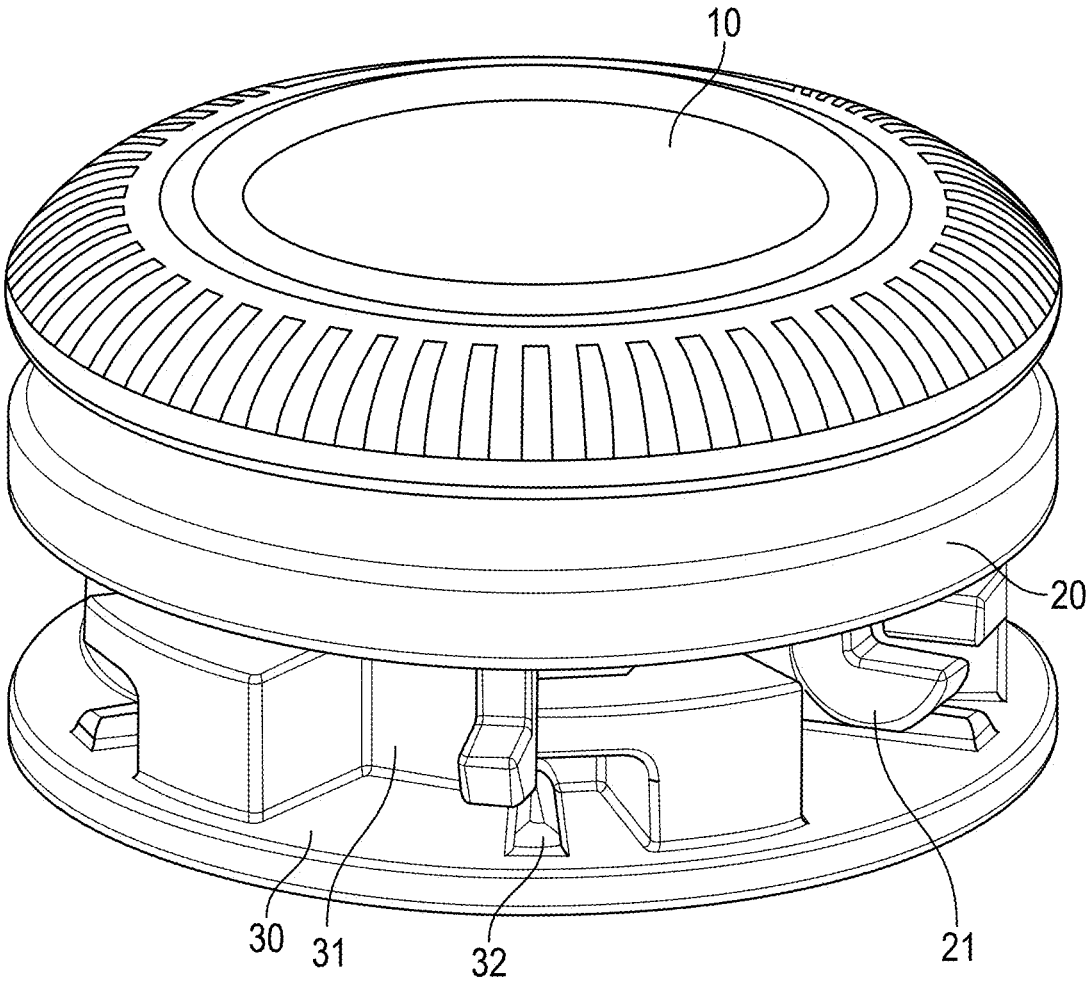
FIG. 1 is a front schematic view of the snap and lock button device open design.

FIG. 1 is a front schematic view of the invention in the preferred embodiment with the open design. The preferred embodiment is not intended to limit the scope of the invention. The preferred embodiment of the invention includes five parts: the ridged top plate 10 containing the star-shaped open clasp male fastener 11, the plate 20 containing the star-shaped open clasp female fastener 22 which connects to plate 10 and also contains hinges 21 on the reverse side of the female fastener, the plate 30 that receives the hinges 21 in cavities 31, a structure 40 that receives the plate 10 and plate 20 and allows the combined plates 10 and 20 to be rotated together into a fixed and secure position, and a rivet 50 that attaches the invention to an article of clothing.

Figure 2:
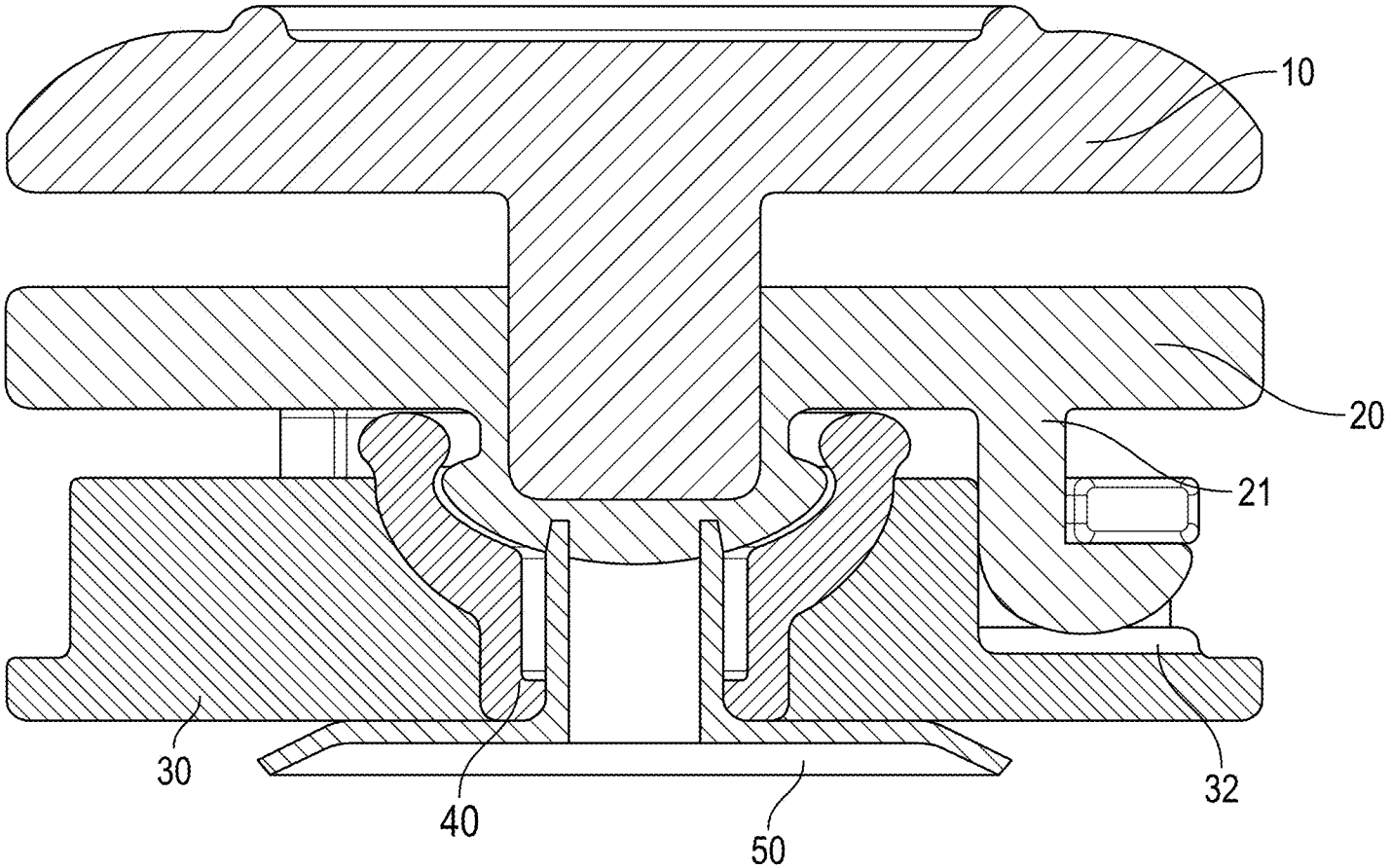
FIG. 2 is a cross-sectional view of the device shown in FIG. 1 taken from the center of the device.

FIG. 2 shows the cross-sectional view of the invention taken from the center of the invention. The ridged top plate 10 is shown attached to plate 20 with fastener 11 inserted to fastener 22 by snapping in place with applied downward force. Plate 20 with hinges 21 is locked in place with plate 30 with hinges 21 inside cavities 31 with said hinges inserted in said cavities and rotated approximately 37 degrees into a locked position. Bumper guides 32 guide hinges 21 into cavities 31 into a locked position keeping them from moving into the text cavity. Plate 20 is shown connected into structure 40 by snapping in place with applied downward force. Rivet 50 is shown detached from the invention and from an article of clothing.

Figure 3A:
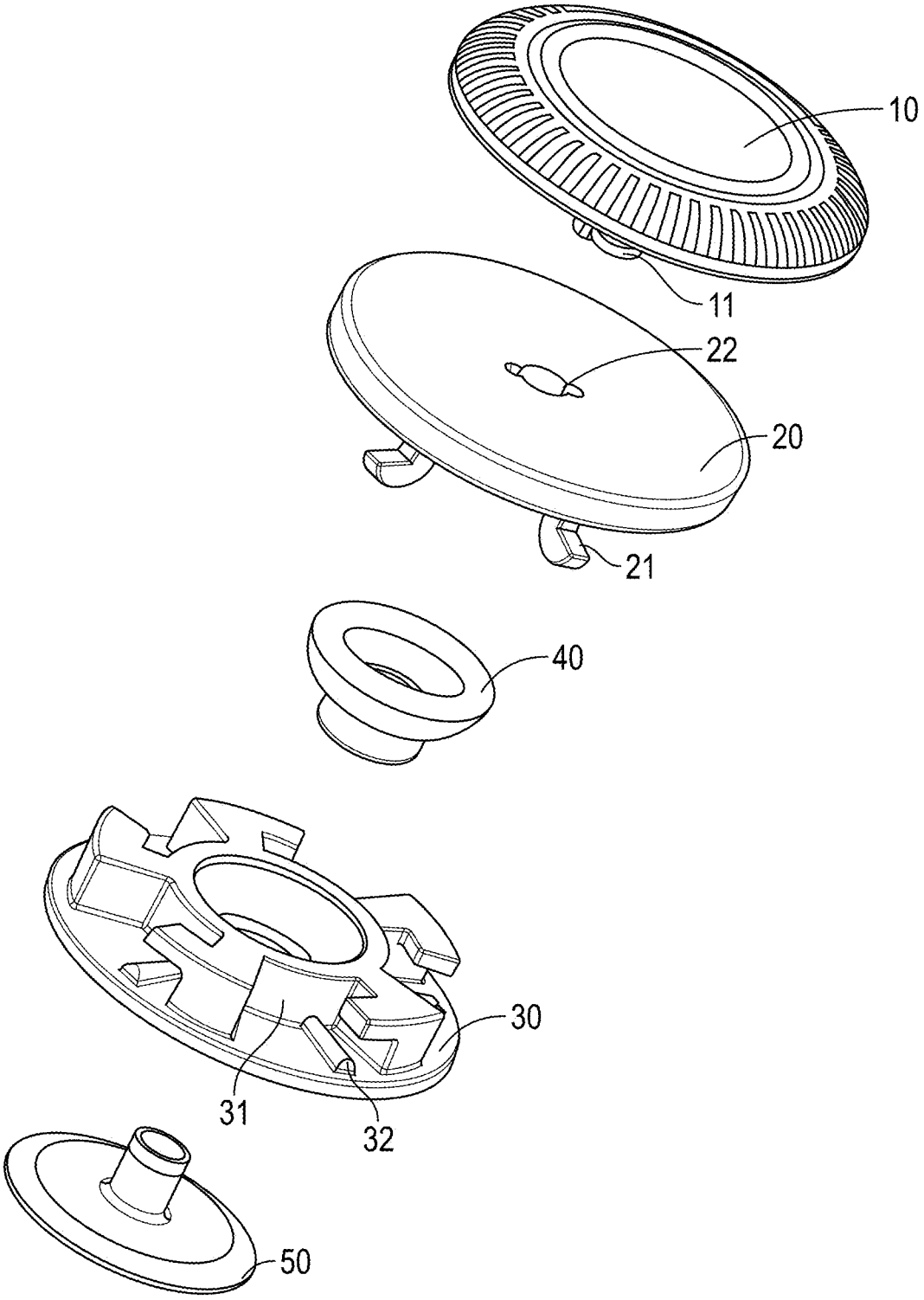
FIG. 3A is a semi-exploded angled view of the device shown in FIG. 1.

FIG. 3A is a semi-exploded view of the invention in the preferred embodiment. The ridged top plate 10 containing the star-shaped open clasp male fastener 11 is shown separated from plate 20. The plate 20 containing the star-shaped open clasp female fastener 22 and hinges 21 is shown detached from the plate 10 containing the male fastener. The plate 20 containing the female fastener and hinges 21 is shown detached from the plate 30 that receives the hinges 21 inside cavities 31 with bumper guides 32.

This FIG. 3A shows the open design for plate 30. Structure 40 that receives the united plate 10 and plate 20 is shown detached. Rivet 50 is shown detached from the invention and from an article of clothing.

Figure 3B:
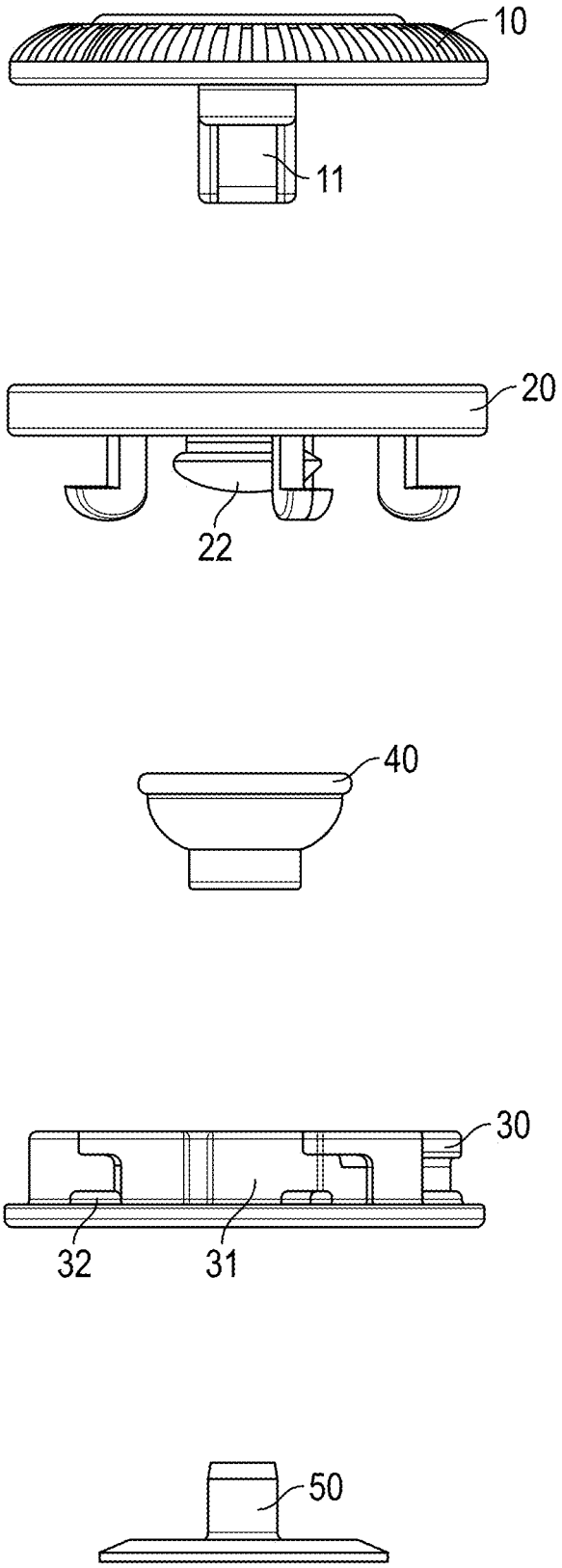
FIG. 3B is a semi-exploded front view of the device shown in FIG. 1.

FIG. 3B is a semi-exploded front view of the invention in the preferred embodiment and while incorporating the detailed description of FIG. 3A above, also shows fastener 11 and fastener 22.

Figure 3C:
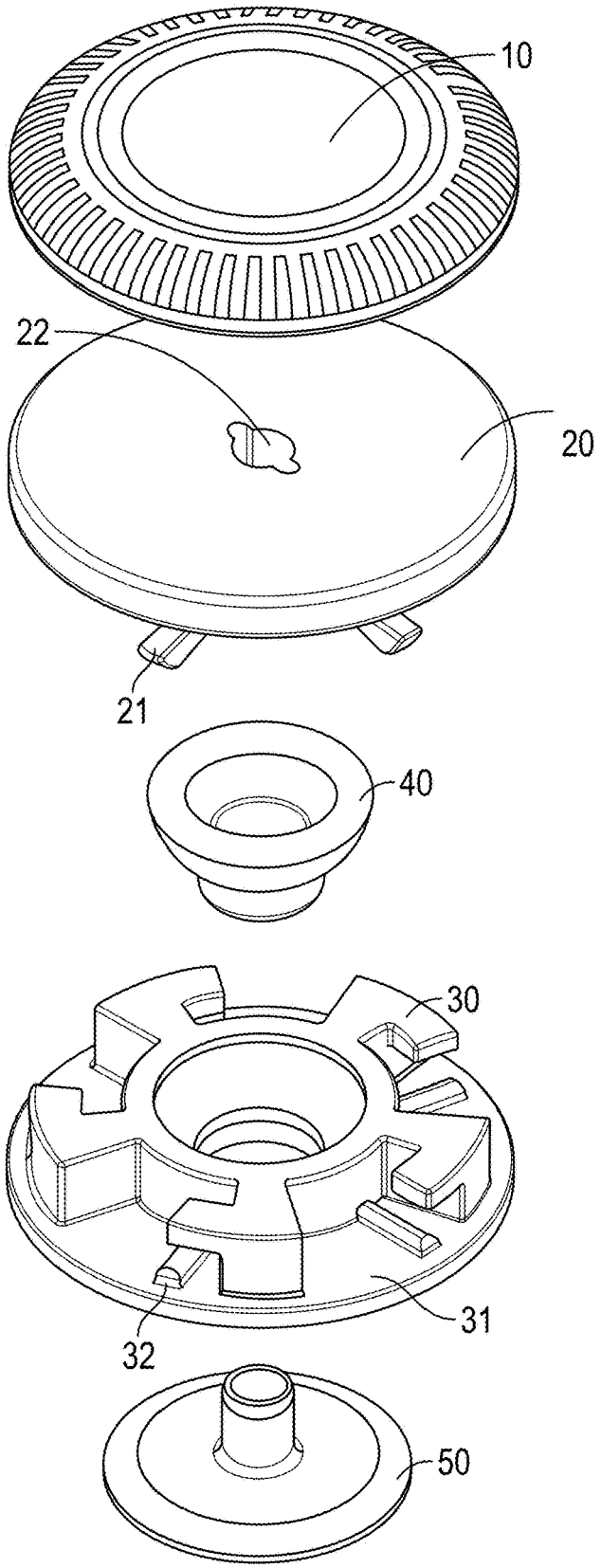
FIG. 3C is a semi-exploded front-angled view of the device shown in FIG. 1.

FIG. 3C is a semi-exploded front-angled view of the invention in the preferred embodiment and while incorporating the detailed description of FIG. 3A above.

Figure 4:
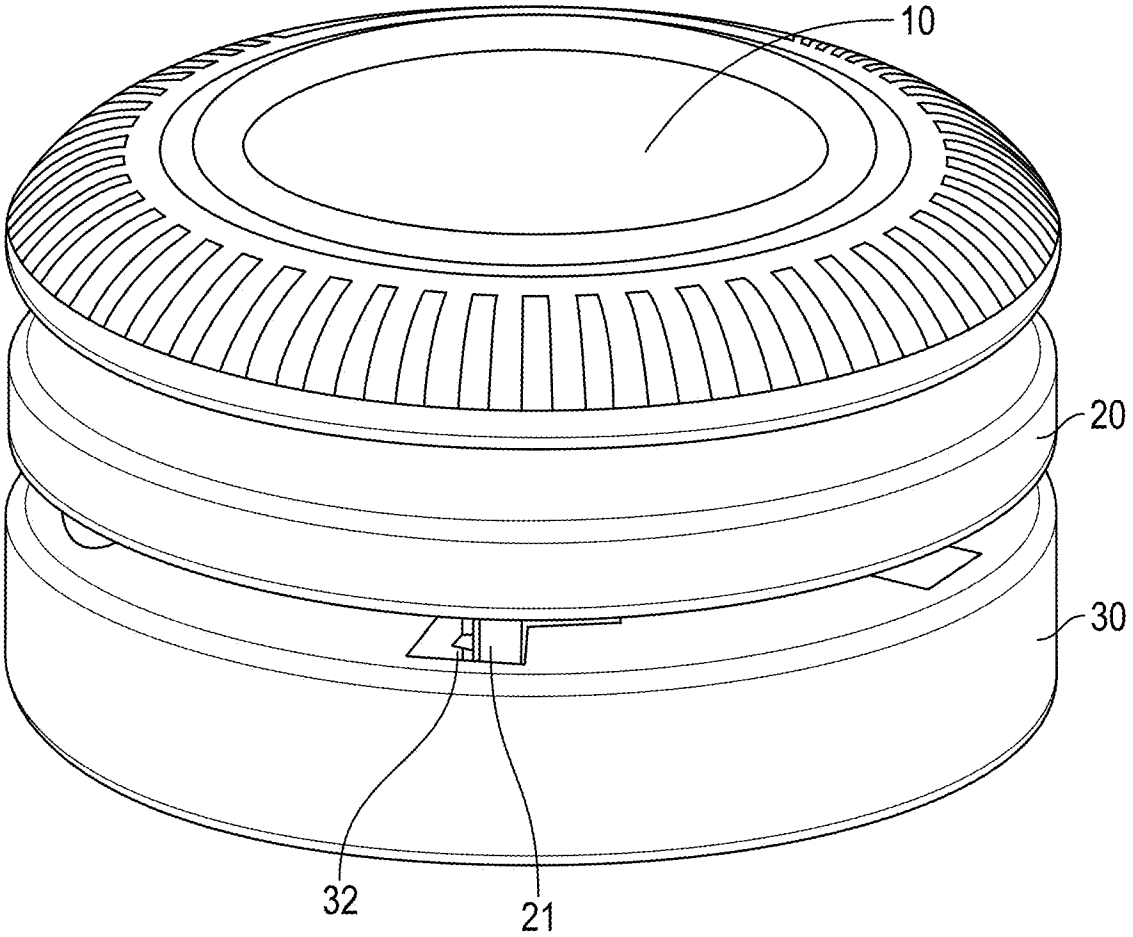
FIG. 4 is a front schematic view of the snap and lock button device closed design.

FIG. 4 is a front schematic view of the invention in the preferred embodiment with the closed design for plate 30, and incorporates the detailed description of FIG. 1.

Figure 5:
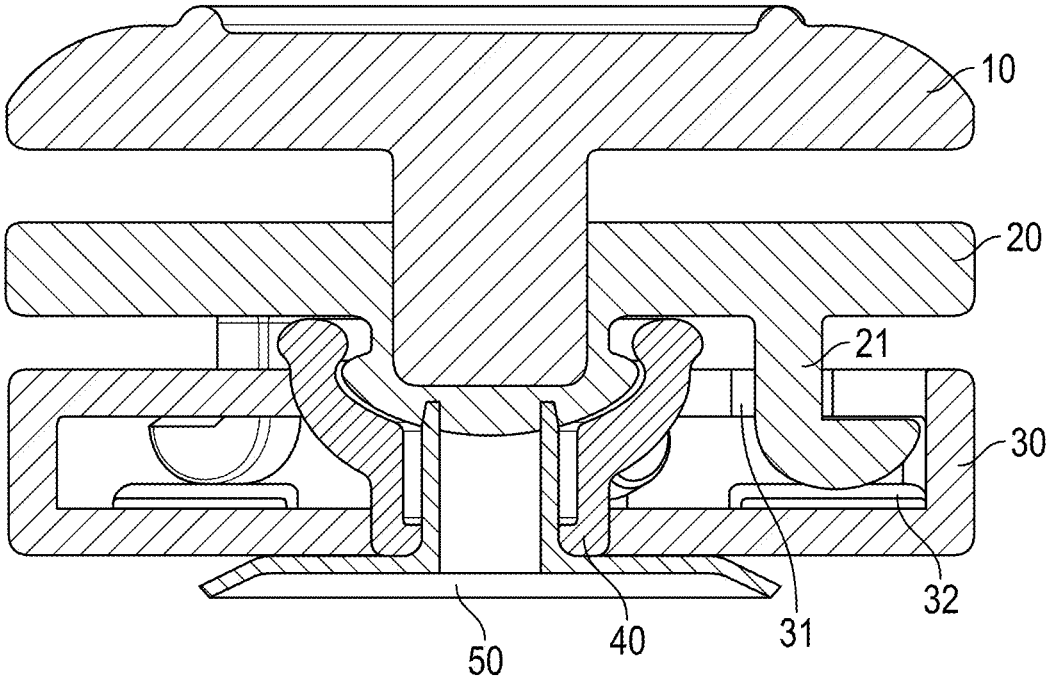
FIG. 5 is a cross-sectional view of the device shown in FIG. 4, taken from the center of the device.

FIG. 5 shows the cross-sectional view of the invention taken from the center of the invention with the closed design for plate 30, and incorporates the detailed description of FIG. 2 above.

Figure 6A:
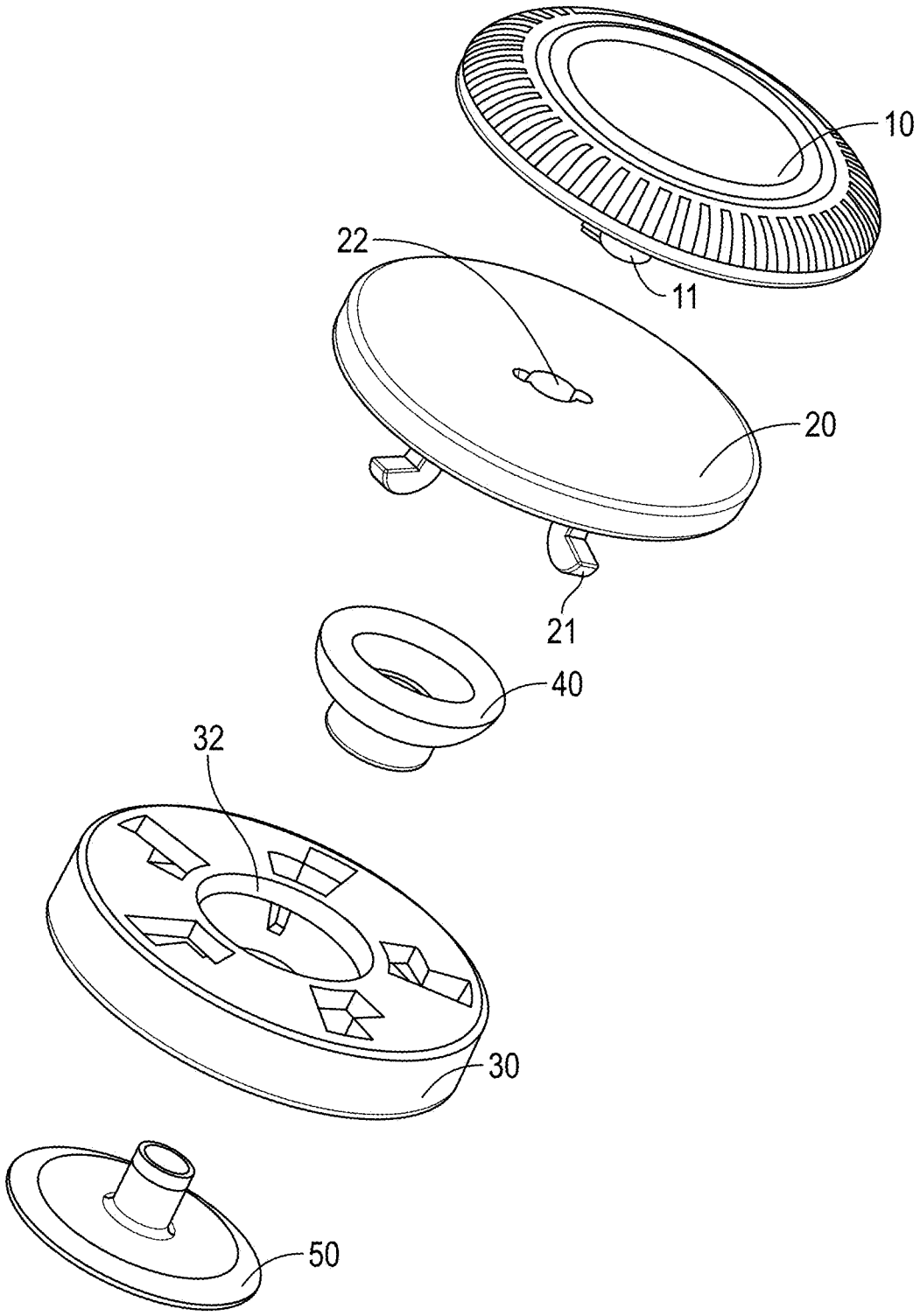
FIG. 6A is a semi-exploded angled view of the device shown in FIG. 4.

FIG. 6A is a semi-exploded view of the invention with the closed design for plate 30, and incorporates the detailed description of FIG. 3A above.

Figure 6B:
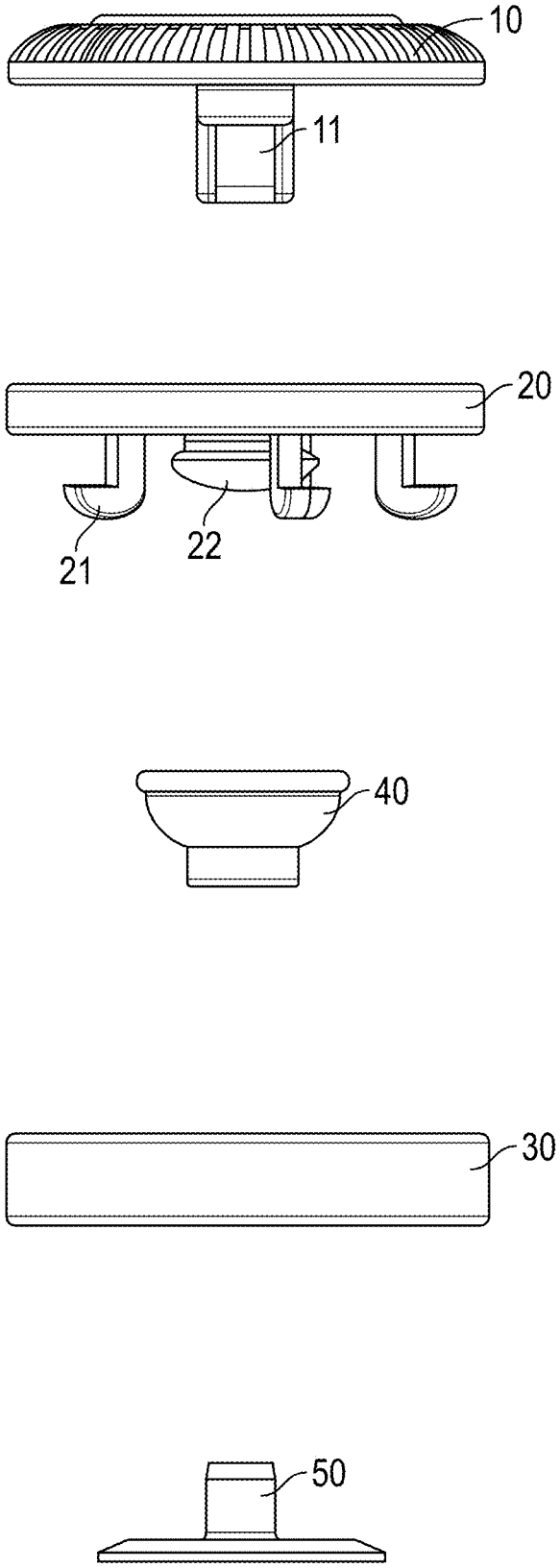
FIG. 6B is a semi-exploded front view of the device shown in FIG. 4.

FIG. 6B is a semi-exploded front view of the invention with the closed design for plate 30, and incorporates the detailed description of FIG. 3B above.

Figure 6C:
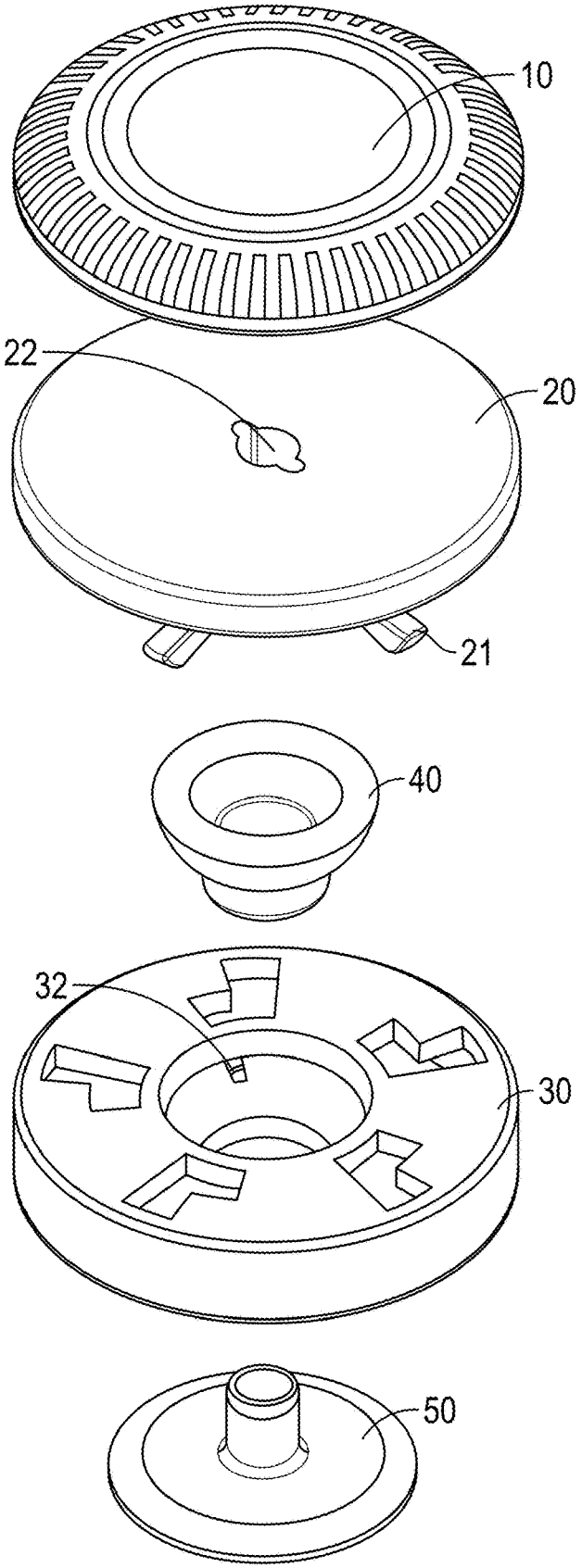
FIG. 6C is a semi-exploded front-angled view of the device shown in FIG. 4.

FIG. 6C is a semi-exploded front-angled view of the invention with the closed design for plate 30, and incorporates the detailed description of FIG. 3C above.

Figure 7:
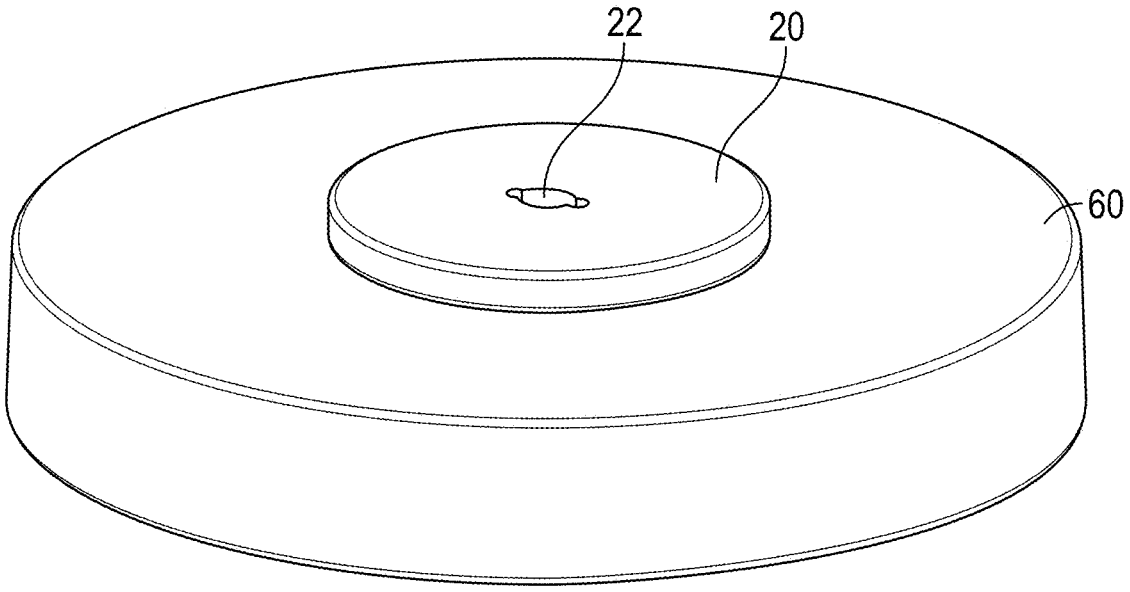
FIG. 7 is a front schematic view of the snap and lock button installation device.

FIG. 7 is a front-angled view of the plate 20 enclosed in installation device 60, said installation device holds the invention in place and guides installation and assembly of the invention.

Figure 8:
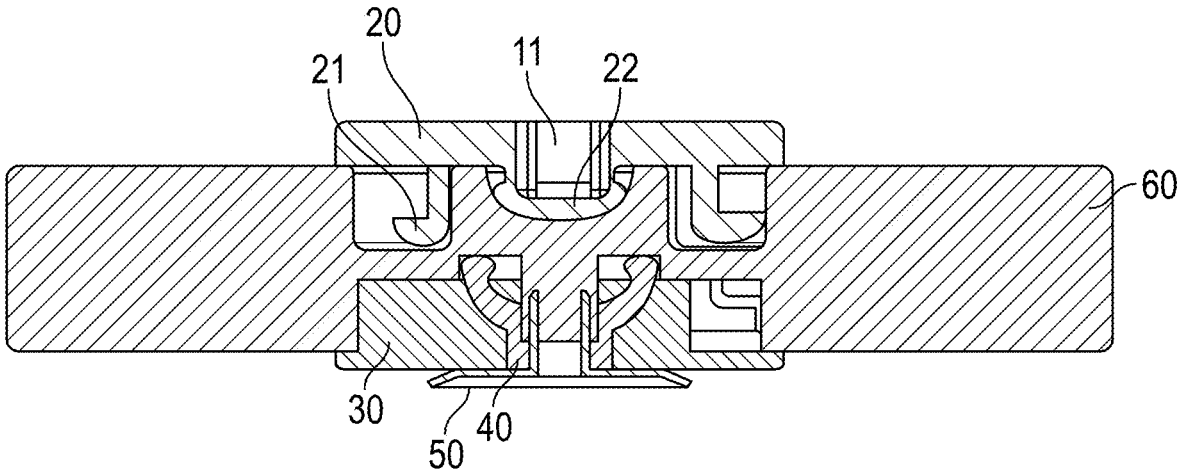
FIG. 8 is a cross-sectional view of the device shown in FIG. 7, taken from the center of the device with the open design.

FIG. 8 shows the cross-sectional view of the installation device 60 operating on the invention taken from the center of said device. In this FIG. 8, plate 30 is in the open design. The detailed description of FIG. 2 above is incorporated herein this FIG. 8.

Figure 9:
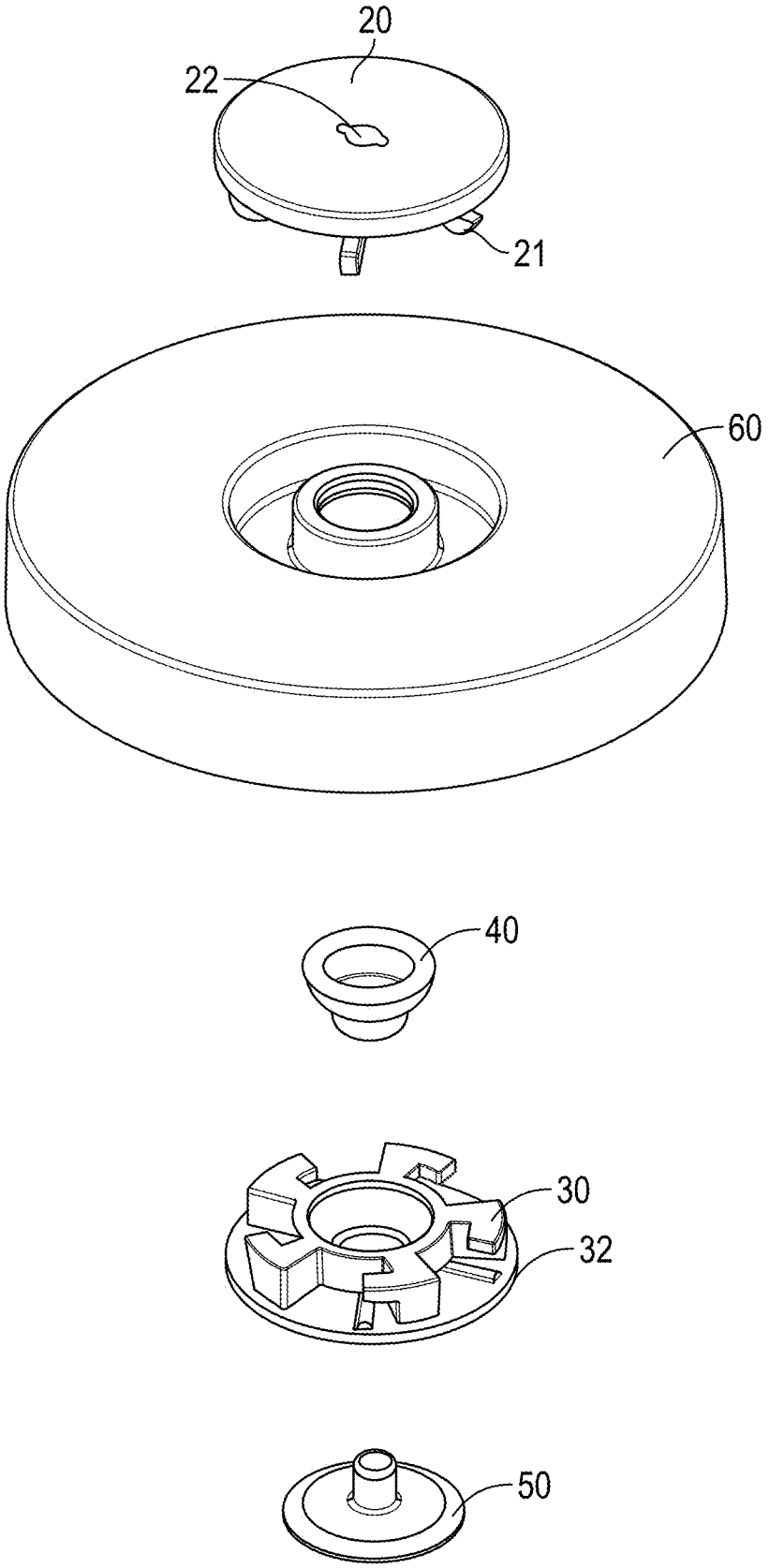
FIG. 9 is a semi-exploded front-angled view of the device shown in FIG. 7 with the open design.

FIG. 9 is a semi-exploded front-angled view of the installation device 60 operating on the invention while incorporating the detailed description of FIG. 3A above. In this FIG. 9, plate 30 is in the open design. Plate 10 is not shown in this FIG. 9.

Figure 10:
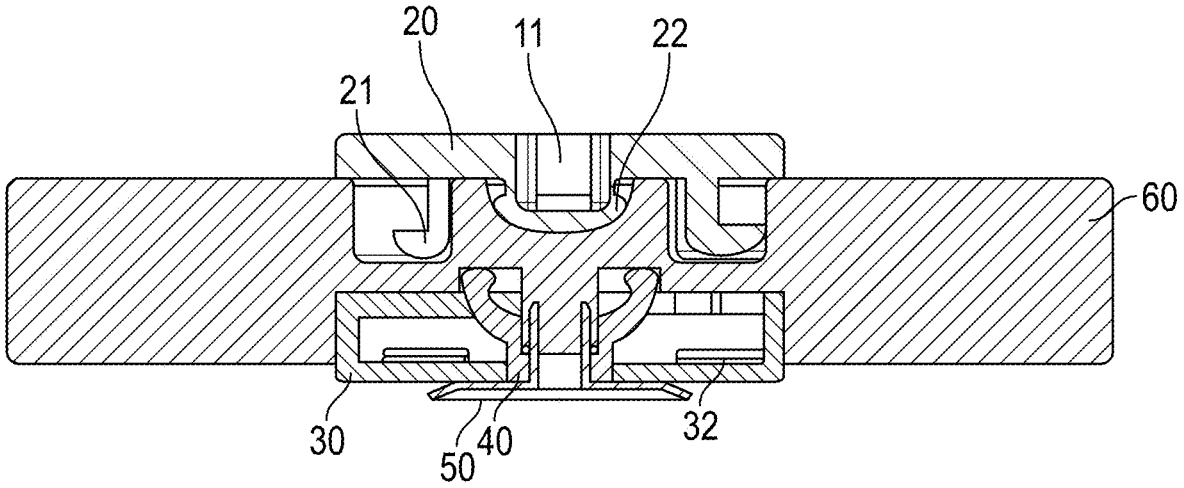
FIG. 10 is a cross-sectional view of the device shown in FIG. 7, taken from the center of the device with the closed design.

FIG. 10 shows the cross-sectional view of the installation device 60 operating on the invention taken from the center of said device. In this FIG. 10, plate 30 is in the closed design. The detailed description of FIG. 2 above is incorporated herein this FIG. 10.

Figure 11:
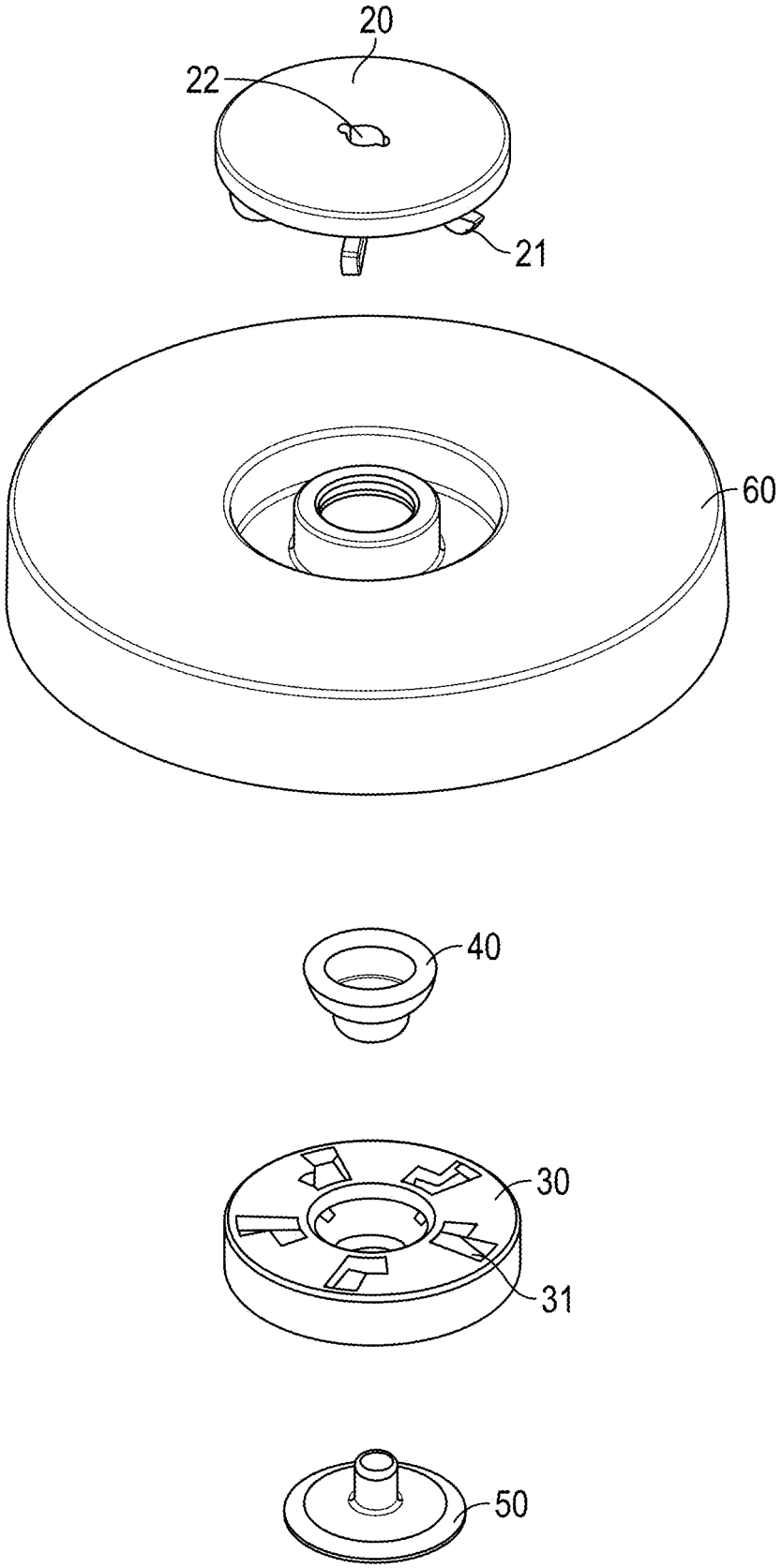
FIG. 11 is a semi-exploded front-angled view of the device shown in FIG. 7 with the closed design.

FIG. 11 is a semi-exploded front-angled view of the installation device 60 operating on the invention while incorporating the detailed description of FIG. 3A above. In this FIG. 11, plate 30 is in the closed design. Plate 10 is not shown in this FIG. 11.

What is claimed is:

1. A fastener system, comprising:

a top member, the top member comprising a top planar structure, the top planar structure comprising a first surface and a second surface opposite the first surface, the top planar structure further comprising a top center;

a plurality of hinges coupled to the top member, each of the plurality of hinges extending radially outward from the top center; and a bottom member comprising a bottom center, the bottom member configured to detachably couple with the top member upon concentric alignment of the top center with the bottom center, the bottom member further comprising a plurality of cavities disposed equidistant from the bottom center, the plurality of cavities each comprising an unlocked zone and a corresponding locked zone, the locked zone comprising a locking element;

wherein each of the plurality of hinges is configured to initially enter the unlocked zone of one of the plurality of cavities upon concentric alignment of the top center with the bottom center, each of the plurality of hinges configured a degree of rotation relative to the bottom member away from the unlocked zone to enter the corresponding locked zone, wherein the locking element of each corresponding locked zone engages with one of the plurality of hinges to inhibit rotation back into the unlocked zone.

2. The fastener system of claim 1, wherein each of the plurality of hinges extend radially outwardly from the top center in a direction parallel with both the top surface and the bottom surface.

3. The fastener system of claim 1, each of the plurality of hinges further comprising a terminal end, wherein each terminal end is disposed equidistant from the top center.

4. The fastener system of claim 3, wherein each terminal end is configured to engage each locking element.

5. The fastener system of claim 4, wherein the locking element is configured to engage with at least one side of the terminal end.

6. The fastener system of claim 1, wherein each unlocked zone is disposed between the corresponding locked zone and a locked zone from a neighboring cavity.

7. The fastener system of claim 6, wherein each corresponding locked zone is disposed between the unlocked zone of the same cavity and an unlocked zone from a neighboring cavity.

8. The fastener system of claim 1, wherein the plurality of hinges comprises a number of hinges, and the plurality of cavities comprises a number of cavities, such that the number of hinges equals the number of cavities.

9. The fastener system of claim 1, the locking element further comprising a tapering surface.

10. The fastener system of claim 1, wherein each corresponding locked zone is configured to prevent a hinge disposed therein from rotation into an unlocked zone of a neighboring cavity.

11. The fastener system of claim 1, wherein each of the plurality of cavities comprises a same volume.

12. The fastener system of claim 1, wherein each locking element is disposed equidistant from the bottom center.

13. The fastener system of claim 1, wherein each locking element is disposed radially even about the bottom center.

14. The fastener system of claim 1, wherein each of the plurality of cavities is disposed radially even about the bottom center.

15. The fastener system of claim 1, wherein each of the plurality of hinges is disposed radially even about the top center.

* * * * *